US005836604A

United States Patent [19]

Piegay

[11] Patent Number: 5,836,604

[45] Date of Patent: Nov. 17, 1998

[54] BOARD FOR GLIDING ON SNOW, INCLUDING A DEVICE FOR MOUNTING A BOOT BINDING

[75] Inventor: Yves Piegay, Meyrieu les Etangs, France

[73] Assignee: Skis Rossignol, S.A., Voiron, France

[21] Appl. No.: 651,146

[22] Filed: May 21, 1996

[30] Foreign Application Priority Data

May 22, 1995 [FR] France ..... 95 063365

[51] Int. Cl.[6] ..... A63C 5/00

[52] U.S. Cl. ..... 280/607; 280/617

[58] Field of Search ..... 280/602, 607, 280/617, 636

[56] References Cited

U.S. PATENT DOCUMENTS

| | | | |
|---|---|---|---|
| 3,915,466 | 10/1975 | Matsuda | 280/617 |
| 4,022,491 | 5/1977 | Powell | 280/607 X |
| 4,592,568 | 6/1986 | Priskich . | |
| 5,393,086 | 2/1995 | Le Mason et al. | 280/602 |
| 5,397,150 | 3/1995 | Commier et al. | 280/607 |
| 5,435,588 | 7/1995 | Commier et al. | 280/602 |

FOREIGN PATENT DOCUMENTS

| | | |
|---|---|---|
| 0490043 | 6/1992 | European Pat. Off. . |
| 0490044 | 6/1992 | European Pat. Off. . |
| 0563569 | 10/1993 | European Pat. Off. . |
| 0577947 | 1/1994 | European Pat. Off. . |
| 2634660 | 2/1990 | France . |
| 2638651 | 5/1990 | France . |
| 2664823 | 1/1992 | France . |

*Primary Examiner*—F. J. Bartuska
*Attorney, Agent, or Firm*—Oliff & Berridge, PLC

[57] ABSTRACT

A board for gliding on snow comprises, in a central part or support region, a device for mounting a boot binding. The device comprises at least two lower elements that are located inside the board and bear, either directly or indirectly, on the lower edge of the board. The device also comprises at least one connecting element that connects the lower elements to at least one upper element, and at least one upper element which is proximate to the upper wall of the board and forms a platform for mounting a boot binding.

24 Claims, 2 Drawing Sheets

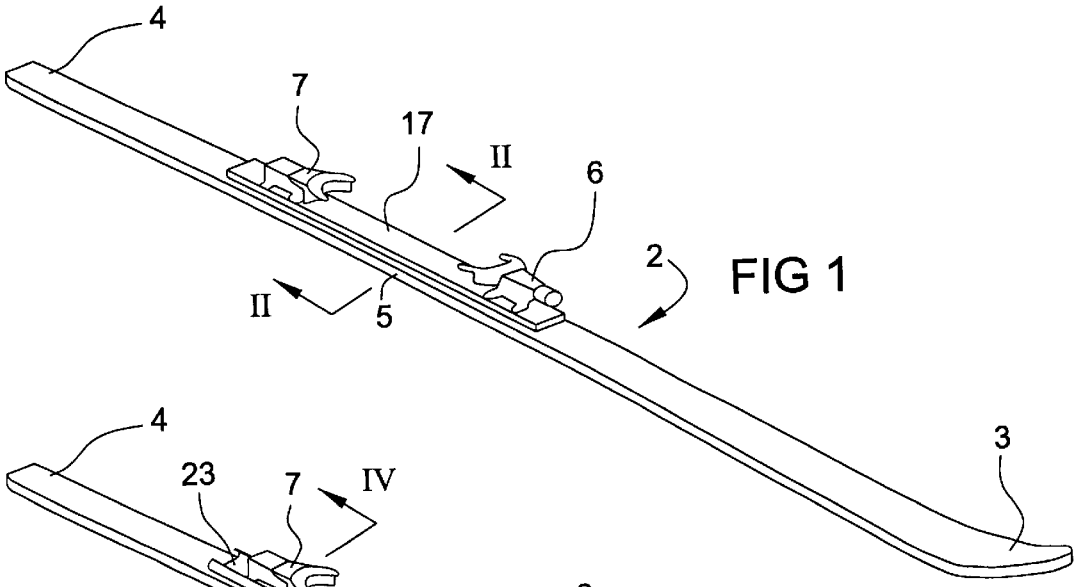
FIG 1
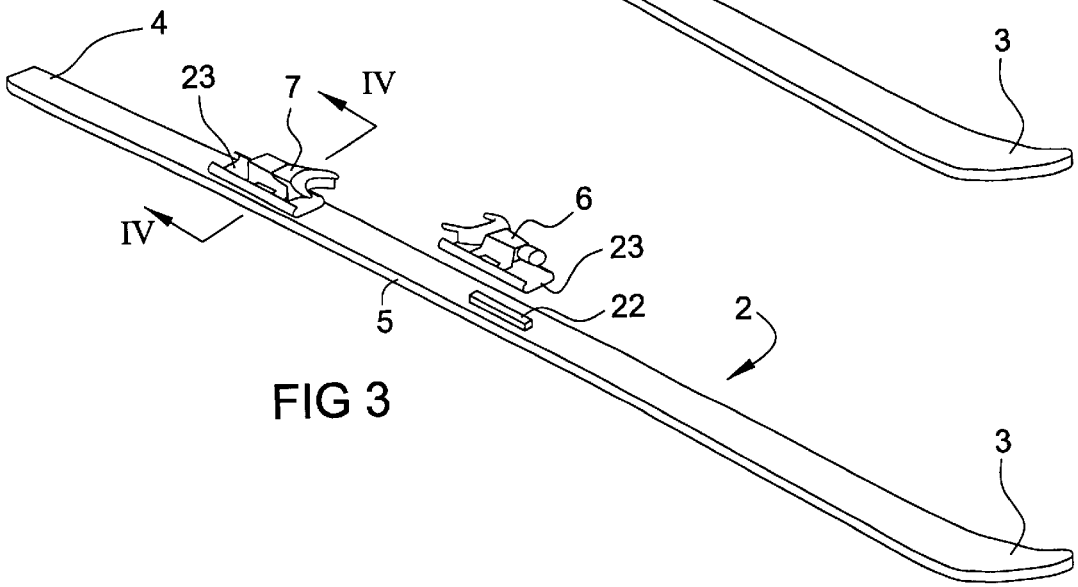
FIG 3
FIG 2
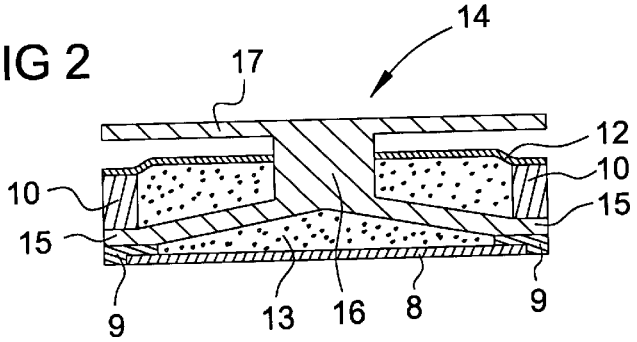
FIG 4
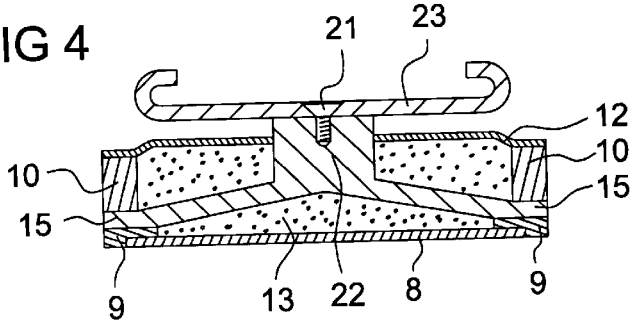

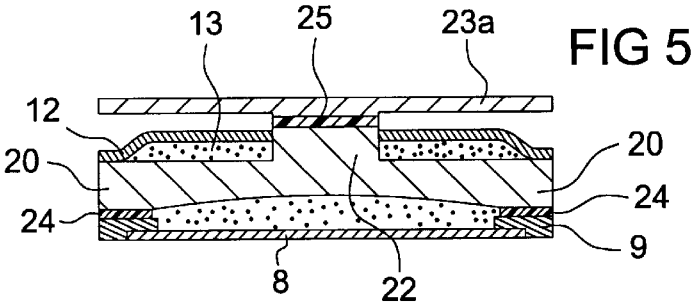
FIG 5
FIG 6
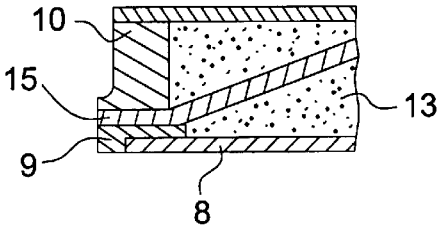
FIG 7
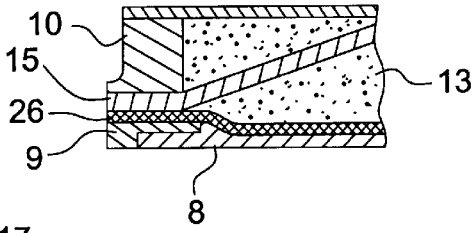
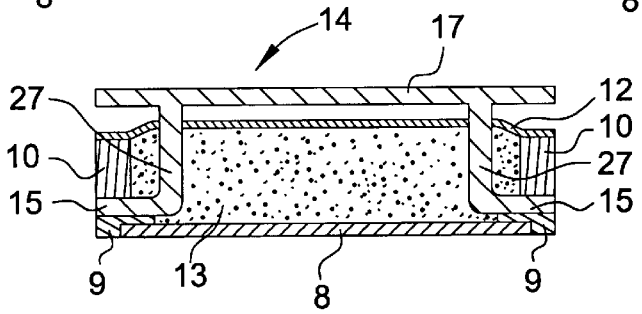
FIG 8
FIG 9
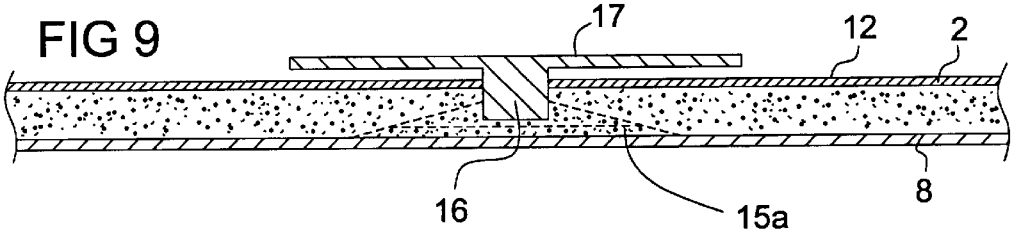
FIG 10
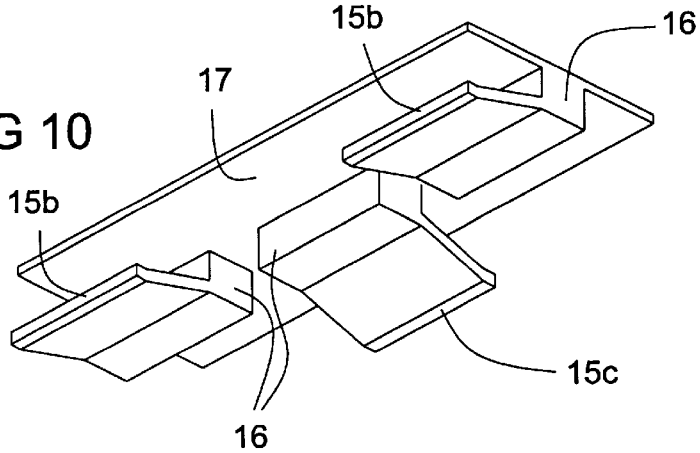

BOARD FOR GLIDING ON SNOW, INCLUDING A DEVICE FOR MOUNTING A BOOT BINDING

BACKGROUND OF THE INVENTION

The subject of the present invention is a board for gliding on snow, such as a ski including a device for mounting a boot binding. The board according to the invention may be an alpine ski, a cross-country ski, a monoski or a snowboard.

DESCRIPTION OF THE PRIOR ART

An alpine ski is traditionally equipped with a boot binding on its upper face, this binding most often having a toe piece and a heel piece, which are placed on the upper face of the ski and are fixed by screwing into the body of the ski.

Very schematically, an alpine ski consists of a lower assembly composed of a sole boarded by metal edges and optionally covered with a reinforcing element, and an upper assembly composed of at least one filler core, a reinforcing element and an outer casing, either made of one part in the form of a shell or made of a plurality of parts composed of side walls and a protective upper element.

In the case of a shell ski, the base of the shell very often consists of two sides bearing over a part of their width on the lower assembly, that is to say either directly on the metal edges or on the reinforcing element covering these edges or, finally, on an intermediate film (adhesive film or elastic film).

In order to ensure that the ski is guided correctly, it is important for the forces to be transferred as directly as possible between the boot of the skier and the ski edge bearing on the snow. However, the number of structural elements of the ski through which the forces must pass between the snow and the boot constitutes an unfavorable factor for correct guiding of the ski.

This phenomenon is amplified when a raising device is used for mounting the boot binding.

Because current skis are narrower in the support region, that is to say in the region where the bindings are mounted, than previously, the boot protrudes on either side of the side walls of the ski. The result of this, when the edges are set on a deep slope, is that the boot may bear on the surface of the snow, which results in an unbalancing of the skier which may cause him to fall, or at the very least cause him to lose time, which is detrimental during a race.

In order to overcome this drawback, consideration has been given to mounting a raised plate on the upper face of the ski, this place enabling the ski to tilt through a larger angle relative to the snow before the boot bears on the surface of the latter.

Some plates are made of metal and are fixed simply on the upper face of the ski, merely forming spaces between this upper face and the baseplate of the toe piece or of the heel piece.

It is also known to fix on the upper face of the ski a raised plate consisting of a layer of viscoelastic material, bonded onto the ski, and covered with a stress plate. Various embodiments relying on this basic design can be envisaged, as described, in particular, in documents FR-A-2 638 651 and FR-A-2 664 823.

Further to the raising of the boot relative to the snow, such a solution makes it possible to provide an effect of unclamping the boot relative to the ski, and also a damping effect, in particular by shearing of the layer of viscoelastic material between the upper face of the ski and the stress plate. When a ski flexes, the toe piece and the heel piece constituting the binding move toward each other, which exerts a pressure on the sole of the boot, resulting in the ski being stiffened in this region and therefore the behavior of the ski being modified relative to its theoretical behavior. It is therefore beneficial to avoid this phenomenon by providing a degree of unclamping of the boot/binding assembly relative to the ski, giving back the latter freedom to deform.

It is also known from document EP-A-0 490 044 to produce a ski consisting of a first lower assembly, or base, and a second upper assembly, or stiffener, fixed on the base. The stiffener acts as a long platform on which the boot binding is mounted.

In the solutions set out above, the binding is mounted on an element which is itself fixed on the upper face of the ski. However, in order to ensure the best possible guiding of the ski, it is important for the forces to be transferred as directly as possible between the ski edge bearing on the snow and the boot of the skier. Yet the interposition of a raised platform increases the number of elements through which the forces must be transferred between the snow and the boot, which constitutes a factor which is unfavorable for correct guiding of the ski.

SUMMARY OF THE INVENTION

The object of the invention is to provide a ski equipped with a device for mounting the boot fastening which ensures the most direct possible transfer of forces between the snow and the boot of the skier.

To this end, the board for gliding on snow to which it relates, of the type comprising a lower assembly comprising a sole bordered by lower edges and, optionally, a reinforcing element, and an upper assembly comprising at least one filler core, a reinforcing element and an outer casing either made of one part in the form of a shell or made of a plurality of parts composed of side walls and a protective upper element comprises, in the central part or support region:

- at least two lower elements in the form of feet arranged inside the ski, located on each side thereof and bearing on the lower assembly, either directly on the lower corners or indirectly on the latter, via a reinforcement or an elastic joint,
- at least one upper element which, arranged above the upper wall of the ski or level with this wall, forms a platform for mounting the binding, and
- at least one connecting element between the lower elements and the upper element, which is located inside the ski and passes through the upper wall of the latter.

The force exerted by the foot of the skier is transferred directly to the lower corners of the ski through the device comprising of the platform, the connection and the feet.

In such a case, the force therefore does not pass through the structure of the ski, and therefore through the various components of the latter which may distort this force.

According to a first possibility, the lower and connecting elements and the platform comprise of a monobloc piece, it being possible for this piece to have, seen in cross section, the general shape of an H laid on its side, a general X-shape or a general inverted U-shape.

According to another possibility, in this case, the lower and connecting elements comprise of a monobloc piece, of general Y-shape or inverted T-shape, on the upper face of which the upper element forming a platform is removably fixed.

It is thus possible to attach the platform onto the upper face of the monobloc piece, which may have advantages, in particular by providing platforms which are specific to the various bindings which can be mounted on the ski.

According to one possibility, the upper element is mounted on the connecting element with the interposition of a damping element chosen from viscoelastic or hyperelastic materials.

Depending on the behavior characteristics which it is desired to obtain, the lower elements are mounted on the lower corners or on a reinforcing element covering the latter with the optional interposition of a damping material.

According to one embodiment, the lower elements, the connecting element or elements and the upper element extend over the entire length where the boot binding is mounted, the upper element forming a continuous platform.

According to another possibility, in the case of an alpine ski, the lower elements, the connecting element or elements and the upper element are arranged in two separate longitudinally offset assemblies, the front one of which is used for mounting the front toe piece and the rear one of which is used for mounting the heel piece of the binding.

According to one possibility, the device for mounting the binding is asymmetrical with respect to the longitudinal mid-plane of the ski. For example, the number and the longitudinal position of the various connecting and lower elements differ along the two sides of the platform.

According to another embodiment, the platform is longer than the lower elements in the form of feet and protrudes longitudinally on either side of them.

According to another embodiment, the connecting elements and/or the lower elements have different lengths on the two sides of the ski.

The platform may either be used for mounting a standard binding, for example one that is screwed, or consist of a slide channel forming a base receiving the body of the boot binding, toe piece or heel piece. This second solution makes it possible to limit the number of pieces forming the assembly, since only a single piece is used both as a platform and as the longitudinal slide channel in which the binding body is mounted adjustably and in known fashion.

In any case, the invention will be easily understood with the aid of the following description which follows, with reference to the appended schematic drawing representing several embodiments of this ski by way of nonlimiting examples:

BRIEF DESCRIPTION OF THE DRAWINGS

FIG. 1 is a perspective view of a first alpine ski, equipped with a platform extending throughout the region for mounting the bindings;

FIG. 2 is a view in section along the line II—II in FIG. 1;

FIG. 3 is a view of another ski, in which the platform is made of several parts and is removable;

FIG. 4 is a view in section along the line IV—IV in FIG. 3, without the binding being represented;

FIG. 5 is a view in section, similar to FIG. 4, showing a platform connected to the lower and connecting elements by a viscoelastic joint;

FIGS. 6 and 7 are two detail views, in cross section, representing the bearing of an element on an edge:

FIG. 8 is a cross-sectional view, in the support region, of another ski;

FIG. 9 is a view in longitudinal section of another ski in the support region;

FIG. 10 is a perspective view, from below, of an asymmetric raising device.

DESCRIPTION OF THE PREFERRED EMBODIMENTS

FIG. 1 represents an alpine ski 2 having a tip 3, a heel 4 and a central part 5, or support region, intended to accommodate a boot binding comprising of a toe piece 6 and a heel piece 7.

As more especially shown in FIG. 2. this ski includes a running sole 8, longitudinal edges 9 arranged on either side of the sole, lateral reinforcing elements 10 forming the sides of the ski, an optionally profiled upper wall 12 and a filler core 13, for example made of polyurethane.

According to the essential characteristic of the invention, in its support region this ski comprises a monobloc piece 14, in the general shape of a very open X, having two elements 15, in the form of feet, arranged inside the body of the ski and each bearing on one edge 9, an intermediate connecting part 16 arranged inside the body of the ski and protruding from the upper face of the ski, and an upper element 17 forming a continuous platform on which the toe piece 6 and the heel piece 7 are fixed, for example by screwing.

FIGS. 3 and 4 represent an alternative embodiment of this ski, in which the same elements are denoted by the same references as before. In this case, the ski is equipped with two separate longitudinally offset raising assemblies, the front one of which is used for mounting the toe piece 6 and the rear one of which is used for mounting the heel piece of the binding. An element 15 bears on each edge 9, the elements 15 being extended by an intermediate part 22 which passes through the upper wall 12 of the ski. The platform 23 is fixed onto the intermediate part 22 using screws 21. In this case, the platform 23 has a longitudinal slide channel shape, which is open at the top, constituting the base for adjustably mounting the body of the binding, toe piece or heel piece.

In the embodiment represented in FIG. 5. an element 20 bears on each edge 9, this element 20 being thick enough to itself form one side of the ski in the region in question, the elements 20 being extended upward by an intermediate element 22 which protrudes from the upper face of the ski, as is shown, in particular, in FIG. 3. A platform 23*a*, intended for mounting the toe piece 6, is fixed on the upper face of the intermediate element 22. The mounting of the heel piece 7 is entirely analogous. It may be noted that this platform 23*a* may be specific to the toe piece 6. Mounting may be carried out, for example, using screws (not shown). In the embodiment represented in FIG. 5, a layer 24 of viscoelastic material is provided between each lower element 20 and the corresponding edge 9, as well as a layer of viscoelastic material 25 between the intermediate element 22 and the platform 23*a*.

FIG. 6 is a detailed view of FIG. 2, showing direct bearing of a foot 15 on the upper face of an edge 9. FIG. 7 represents a variant in which a lower reinforcing element 26 is arranged between the foot 15 and the edge 9.

FIG. 8 represents a variant of the embodiment in FIG. 2, in which each foot 15 is connected to the upper element 17 by an intermediate part 27 located inside the body of the ski, and close to one of the lateral elements 10, or cants, of the latter. The upper element 17 and the intermediate part 27 define an assembly in the shape of an inverted U.

FIG. 9 represents the central part, or support region, of another ski seen in longitudinal mid-section, in which the element 17 constituting a platform is connected by a connecting element 16 to lower elements 15*a*, in the form of feet, bearing on the edges. Each element 15*a* attached to the element 16 is shorter than the element 17. The element 17 constituting a platform is therefore mounted overhanging relative to the feet 15*a*.

FIG. 10 represents a device according to the invention on its own, in perspective and from below. In this case, the upper element 17 constituting a platform is connected via a connecting element 16, on the one hand to two lower elements 15*b* in the form of feet, bearing on a first edge of the ski and, on the other hand, to a lower element 15*c* in the form of a foot, bearing on the other edge of the ski.

As can be seen from the above description, the invention provides a great improvement to the prior art by providing a ski which is equipped with a platform and whose structure is such that the transfer of forces between the snow and the boot binding takes place as directly as possible at the lower corners of the ski.

As is obvious, the invention is not limited just to those embodiments of this ski which have been described above by way of examples, but instead encompasses all variants thereof. Thus, in particular, the platform (17) could rest on the upper face of the ski or be fitted into the upper wall thereof, or the ski could be replaced by another board for gliding on snow such as a monoski or snowboard, without thereby departing from the scope of the invention.

What is claimed is:

1. A board for gliding on snow, comprising:

a lower assembly comprising a sole bordered by edges;

an upper assembly comprising at least one filler core, a reinforcing element, and an outer casing made of at least one part; and a device, located in a central support region of the board, for mounting a boot binding, wherein said device comprises:

at least two lower elements located inside and on each side of the board, that bear on said edges of said lower assembly, at least one upper element located above said outer casing of said upper assembly or level with the top of said outer casing, said at least one upper element defining a platform for mounting said binding, and at least one connecting element between each of said lower and upper elements, at least a portion of said at least one connecting element being located inside the board and passing through the top of said upper assembly.

2. The board of claim 1, wherein said outer casing is in the form of a shell.

3. The board of claim 1, wherein said outer casing comprises side walls and a protective upper element.

4. The board of claim 1, wherein a reinforcing element or an elastic joint is located between the edges of the lower assembly and said at least two lower elements.

5. The board of claim 4, wherein a reinforcing element is located between the edges of the lower assembly and said at least two lower elements.

6. The board of claim 1, wherein said at least two lower elements bear directly on the edges of the lower assembly.

7. The board of claim 1, wherein said at least two lower elements bear indirectly on the edges of the lower assembly.

8. The board of claim 1, wherein said at least two lower elements and said at least one connecting element comprise a monobloc piece.

9. The board of claim 8, wherein the monobloc piece has, as seen in cross-section, the general shape of an H laid on its side.

10. The board of claim 8, wherein the monobloc piece has, as seen in cross-section, a general X shape.

11. The board of claim 8, wherein the monobloc piece has, as seen in cross-section, an inverted U-shape.

12. The board of claim 8, wherein said at least two lower elements and said at least one connecting element comprise a monobloc piece, having a general Y-shape, on an upper face of which said upper element is removably fixed.

13. The board of claim 12, wherein said monobloc piece is in the shape of a T.

14. The board of claim 13, wherein the upper element is mounted on the connecting element through a dampening element selected from the group consisting of viscoelastic materials and hyperelastic materials.

15. The board of claim 1, wherein said at least two lower elements are mounted on said lower assembly with a dampening element.

16. The board of claim 1, wherein said at least two lower elements, said at least one connecting element, and said at least one upper element extend over an entire length where the boot binding is mounted, said at least one upper element forming a continuous platform.

17. The board of claim 1, wherein the board is an alpine ski.

18. The board of claim 17, wherein said at least two lower elements, said at least one upper element, and said at least one connecting element are arranged in two separate longitudinally offset assemblies, a first one of which is used for mounting a front toe piece of said boot binding and a second one of which is used for mounting a heel piece of said boot binding.

19. The board of claim 1, wherein said device is asymmetrical with respect to the longitudinal mid-plane of the board.

20. The board of claim 19, wherein the number and longitudinal position of the various connecting and lower elements differ along the two sides of said upper element.

21. The board of claim 1, wherein said platform protrudes longitudinally on either side of said at least two lower elements.

22. The board of claim 1, wherein said connecting elements, said lower elements, or both, have different lengths on the two sides of the board.

23. The board of claim 1, wherein said platform is intended for mounting a standard boot binding.

24. The board of claim 1, wherein said platform comprises a slide channel which forms a base to receive the body, toe piece, or heel piece of the boot binding.

* * * * *

UNITED STATES PATENT AND TRADEMARK OFFICE

CERTIFICATE OF CORRECTION

PATENT NO. : 5,836,604
DATED : November 17, 1998
INVENTOR(S) : Yves Piegay

It is certified that error appears in the above-identified patent and that said Letters Patent is hereby corrected as shown below:

Title page, item [30], please delete the Foreign Application Priority Date, and insert the following:

--[30] Foreign Application Priority Data

May 22, 1995 [FR] France.....95 06335--

Signed and Sealed this

Sixth Day of June, 2000

*Attest:*

Q. TODD DICKINSON

*Attesting Officer*

*Director of Patents and Trademarks*